US008726637B2

(12) United States Patent
Sekiguchi et al.

(10) Patent No.: US 8,726,637 B2
(45) Date of Patent: May 20, 2014

(54) AIR-FUEL RATIO CONTROL SYSTEM FOR INTERNAL COMBUSTION ENGINE

(75) Inventors: Tooru Sekiguchi, Wako (JP); Atsuhiro Miyauchi, Wako (JP); Takeshi Aoki, Wako (JP); Michinori Tani, Wako (JP); Seiji Watanabe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 99 days.

(21) Appl. No.: 13/565,291

(22) Filed: Aug. 2, 2012

(65) Prior Publication Data

US 2013/0061581 A1 Mar. 14, 2013

(30) Foreign Application Priority Data

Sep. 12, 2011 (JP) ..... 2011-197797
Sep. 12, 2011 (JP) ..... 2011-197798

(51) Int. Cl.
*F01N 3/08* (2006.01)
*F02D 41/00* (2006.01)

(52) U.S. Cl.
USPC ..... 60/277; 60/285; 60/286; 60/295; 60/299

(58) Field of Classification Search
CPC ..... F02D 41/0085; F02D 41/1408; F02D 41/1455; F02D 2041/288; F01N 3/0814; F01N 3/0842; Y02T 10/22; Y02T 10/24
USPC ..... 60/277, 285, 286, 295, 299
See application file for complete search history.

(56) References Cited

U.S. PATENT DOCUMENTS

2011/0047988 A1* 3/2011 Lewis et al. ..... 60/295
2011/0113754 A1* 5/2011 Kohara et al. ..... 60/274
2011/0120100 A1* 5/2011 Yin et al. ..... 60/295
2011/0131952 A1* 6/2011 Onodera et al. ..... 60/274
2011/0173950 A1* 7/2011 Wan et al. ..... 60/274

FOREIGN PATENT DOCUMENTS

JP 2011-144754 A 7/2011

* cited by examiner

*Primary Examiner* — Thomas Denion
*Assistant Examiner* — Dapinder Singh
(74) *Attorney, Agent, or Firm* — Arent Fox LLP

(57) ABSTRACT

An oscillation signal is generated to oscillate the air-fuel ratio with a set frequency which is different from a 0.5th-order frequency (half of the frequency corresponding to a rotational speed of the engine). Air-fuel ratio perturbation control is performed to oscillate the air-fuel ratio according to the oscillation signal. An intensity of the 0.5th-order frequency component and the set frequency component contained in the detected air-fuel ratio signal are calculated. A determination parameter applied to determining an imbalance degree of air-fuel ratios corresponding to the plurality of cylinders is calculated according to the two intensities and determines an imbalance failure that the imbalance degree of the air-fuel ratios exceeds an acceptable limit. A predicted imbalance value, indicative of a predicted value of the imbalance degree, is calculated, and an amplitude of the oscillation signal is set according to the predicted imbalance value.

18 Claims, 9 Drawing Sheets

AIR-FUEL RATIO CONTROL SYSTEM FOR INTERNAL COMBUSTION ENGINE

BACKGROUND OF THE INVENTION

1. Field of the Invention

The present invention relates to an air-fuel ratio control system for an internal combustion engine having a plurality of cylinders, and particularly to a control system which can determine an imbalance failure that air-fuel ratios corresponding a plurality of cylinders in the engine differ with each other more greatly than the allowable limit.

2. Description of the Related Art

Japanese Patent Laid-open Publication No. 2011-144754 (JP-'754) discloses an air-fuel ratio control system which can determine the imbalance failure based on the output signal of the air-fuel ratio sensor disposed in the exhaust system of the engine. According to this system, the air-fuel ratio perturbation control is performed during the engine operation for oscillating the air-fuel ratio with a predetermined frequency, and the imbalance failure is determined using a ratio parameter which is obtained during the perturbation control. The ratio parameter is calculated by dividing an intensity of the 0.5th-order frequency component contained in the output signal of the air-fuel ratio sensor by an intensity of the predetermined frequency component contained in the output signal of the air-fuel ratio sensor. The 0.5th-order frequency component is a component of a frequency which is half of the frequency corresponding to the engine rotational speed. When the imbalance failure occurs, the 0.5th-order frequency component intensity increases, and a value of the ratio parameter increases as the degree of the imbalance failure increases. Accordingly, the imbalance failure can be determined by comparing the ratio parameter with a predetermined threshold value.

According to the system shown in JP-'754, the amplitude of the air-fuel oscillation in the air-fuel ratio perturbation control is fixed to a constant value. Accordingly, the determination accuracy may deteriorate depending on the imbalance degree of the actual air-fuel ratio. The imbalance in the air-fuel ratios occurs, for example, when any one of the fuel injection valves disposed in the plurality of cylinders fails. The imbalance degree therefore can be expressed, for example, with a deviation ratio from the normal value of the fuel injection amount of one fuel injection valve.

FIG. 13A is a graph for explaining this problem. The horizontal axis of FIG. 13A corresponds to an execution number NDET of the determination, and the vertical axis corresponds to the ratio parameter RT. The data group DG1 corresponds to a state where there is no imbalance of the air-fuel ratios, the data group DG2 corresponds to a low-degree imbalance state where the fuel injection amount of one cylinder deviates from the normal value by 10%, and the data group DG3 corresponds to a high-degree imbalance state where the fuel injection amount of one cylinder deviates from the normal value by 40%.

Regarding the data groups DG1 and DG2, the distribution width of values of the ratio parameter RT is comparatively narrow, whereas the distribution width corresponding to the data group DG3 is very wide. Accordingly, in the example shown in FIG. 13A, accuracy of the ratio parameter RT in the high-degree imbalance state decreases, so that a possibility of incorrect determination becomes higher. In FIG. 13A, the data groups DG1 and DG2 are shown as black areas, since the obtained data points exist in a narrow area.

SUMMARY OF THE INVENTION

The present invention was made contemplating the above described point, and an objective of the present invention is to provide an air-fuel ratio control system which can perform the imbalance failure determination of air-fuel ratios with high accuracy regardless of the imbalance degree.

To attain the above objective, the present invention provides an air-fuel ratio control system for an internal combustion engine having a plurality of cylinders. The air-fuel ratio control system includes air-fuel ratio detecting means (15), oscillation signal generating means, air-fuel ratio oscillating means, 0.5th-order frequency component intensity calculating means, set frequency component intensity calculating means, determination parameter calculating means, imbalance failure determining means, predicted imbalance value calculating means, and amplitude setting means. The air-fuel ratio detecting means detects an air-fuel ratio in an exhaust passage of the engine. The oscillation signal generating means generates an oscillation signal to oscillate the air-fuel ratio with a set frequency (f1) which is different from a 0.5th-order frequency (fIMB) which is half of the frequency corresponding to a rotational speed (NE) of the engine. The air-fuel ratio oscillating means oscillates the air-fuel ratio according to the oscillation signal. The 0.5th-order frequency component intensity calculating means calculates an intensity (MIMB) of the 0.5th-order frequency component contained in an output signal (SLAF) of the air-fuel ratio detecting means. The set frequency component intensity calculating means calculates an intensity (MPTf1) of the set frequency component contained in the output signal of the air-fuel ratio detecting means during operation of the air-fuel ratio oscillating means. The determination parameter calculating means calculates a determination parameter (RSRC) applied to determining an imbalance degree of air-fuel ratios corresponding to the plurality of cylinders according to the 0.5th-order frequency component intensity (MIMB) and the set frequency component intensity (MPTf1). The imbalance failure determining means determines an imbalance failure that the imbalance degree of the air-fuel ratios exceeds an acceptable limit, using the determination parameter (RSRC). The predicted imbalance value calculating means calculates a predicted imbalance value (RSRC, UADP) indicative of a predicted value of the imbalance degree. The amplitude setting means sets an amplitude (DAF) of the oscillation signal according to the predicted imbalance value.

With this configuration, the air-fuel ratio perturbation control is performed using the oscillation signal for oscillating the air-fuel ratio with the set frequency which is different from the 0.5th-order frequency, the intensity of the set frequency component contained in the output signal of the air-fuel ratio detecting means, is calculated during execution of the air-fuel ratio perturbation control, and the intensity of the 0.5th-order frequency component is calculated. The determination parameter applied to determining the imbalance degree of air-fuel ratios corresponding to the plurality of cylinders is calculated according to the 0.5th-order frequency component intensity and the set frequency component intensity, and the imbalance failure that the imbalance degree of the air-fuel ratios exceeds the acceptable limit is determined using the determination parameter. Further, the predicted imbalance value indicative of a predicted value of the imbalance degree is calculated, and the amplitude of the oscillation signal is set according to the predicted imbalance value. By appropriately setting the amplitude of the oscillation signal according to the predicted imbalance degree, the air-fuel ratio perturbation control can be performed with the amplitude suitable for the actual imbalance degree, which makes it possible to perform the determination with high accuracy regardless of the imbalance degree of the air-fuel ratios.

Preferably, the amplitude setting means sets the amplitude (DAF) of the oscillation signal to a greater value as the predicted imbalance value (RSRC, UADP) increases.

With this configuration, the amplitude of the oscillation signal is set to a greater value as the predicted imbalance value increases. It is confirmed that such setting of the amplitude of the oscillation signal reduces the range of the calculated determination parameter values, to improve determination accuracy. Consequently, the imbalance failure determination can accurately be performed regardless of the imbalance degree.

Preferably, the determination parameter calculating means calculates the determination parameter (RSRC) by multiplying the amplitude (DAF) of the oscillation signal and a ratio (RT) of the 0.5th-order frequency component intensity (MIMB) to the set frequency component intensity (MPTf1).

With this configuration, the determination parameter is calculated by multiplying the amplitude of the oscillation signal and the ratio of the 0.5th-order frequency component intensity to the set frequency component intensity. Multiplying the amplitude of the oscillation signal offsets a specific component contained in the set frequency component intensity, the specific component depending on the amplitude of the oscillation signal. Accordingly, the determination accuracy can be improved.

Preferably, the predicted imbalance value calculating means calculates the predicted imbalance value (RSRC, UADP) so that the predicted imbalance value (RSRC, UADP) increases as a modified amplitude increases, the modified amplitude being obtained by multiplying the amplitude (DAF) of the oscillation signal and a ratio (RT) of the 0.5th-order frequency component intensity (MIMB) to the set frequency component intensity (MPTf1).

With this configuration, the predicted imbalance value is calculated so as to increase as the modified amplitude increases, wherein the modified amplitude is obtained by multiplying the amplitude of the oscillation signal and the ratio of the 0.5th-order frequency component intensity to the set frequency component intensity. In other words, the predicted imbalance value is calculated with a method which is similar or identical to the calculation method of the determination parameter. Accordingly, the failure determination process is prevented from becoming complicated.

Preferably, the exhaust passage is provided with an exhaust gas purifying catalyst (14), the air-fuel ratio detecting means (15) is upstream air-fuel ratio detecting means disposed upstream of the exhaust gas purifying catalyst (14), and downstream air-fuel ratio detecting means (16) is disposed downstream of the exhaust gas purifying catalyst (14). The air-fuel control system further includes first feedback control means and second feedback control means. The first feedback control means sets a target air-fuel ratio (KCMD) using an integral control term (UADP) of a parameter (σ) indicative of a control deviation so that a detected value (VO2) of the downstream air-fuel ratio detecting means coincides with a downstream target value (VO2TRGT). The second feedback control means controls the air-fuel ratio of an air-fuel mixture burning in the engine so that the air-fuel ratio (KACT) detected by the upstream air-fuel ratio detecting means coincides with the target air-fuel ratio (KCMD). The predicted imbalance value calculating means calculates the predicted imbalance value (UADP) so that the predicted imbalance value (UADP) increases as the integral control term (UADP) increases.

With this configuration, the target air-fuel ratio is set using the integral control term of the parameter indicative of the control deviation so that a detected value of the downstream air-fuel ratio detecting means coincides with the downstream target value, the air-fuel ratio of the air-fuel mixture is controlled so that the air-fuel ratio detected by the upstream air-fuel ratio detecting means coincides with the target air-fuel ratio, and the predicted imbalance value is calculated so as to increase as the integral control term increases. It is confirmed that the integral term increases as the imbalance degree of the air-fuel ratios increases. Accordingly, by calculating the predicted imbalance value so as to increase as the integral term increases, an accurate predicted value of the imbalance degree can be obtained. Further, the predicted imbalance degree is calculated with a method different from the method for calculating the determination parameter, which enables properly setting the amplitude of the oscillation signal and suppressing reduction in determination accuracy, even if errors in the determination parameter temporarily increase due to disturbance or an exchange in the relevant parts.

The present invention provide another air-fuel ratio control system for an internal combustion engine having a plurality of cylinders. The air-fuel ratio control system includes air-fuel ratio detecting means (15), oscillation signal generating means, amplitude setting means, 0.5th-order frequency component intensity calculating means, set frequency component intensity calculating means, determination parameter calculating means, and imbalance failure determining means. The air-fuel ratio detecting means detects an air-fuel ratio in an exhaust passage of the engine. The oscillation signal generating means generates an oscillation signal to oscillate the air-fuel ratio with a set frequency (f1) which is different from a 0.5th-order frequency (fIMB) which is half of the frequency corresponding to a rotational speed (NE) of the engine. The amplitude setting means variably sets an amplitude (DAF) of the oscillation signal. The air-fuel ratio oscillating means oscillates the air-fuel ratio according to the oscillation signal. The 0.5th-order frequency component intensity calculating means for calculates an intensity (MIMB) of the 0.5th-order frequency component contained in an output signal (SLAF) of the air-fuel ratio detecting means. The set frequency component intensity calculating means calculates an intensity (MPTf1) of the set frequency component contained in the output signal (SLAF) of the air-fuel ratio detecting means during operation of the air-fuel ratio oscillating means. The determination parameter calculating means calculates a determination parameter (RSRC) applied to determining an imbalance degree of air-fuel ratios corresponding to the plurality of cylinders by multiplying the amplitude (DAF) of the oscillation signal and a ratio (RT) of the 0.5th-order frequency component intensity (MIMB) to the set frequency component intensity (MPTf1). The imbalance failure determining means determines an imbalance failure that the imbalance degree of the air-fuel ratios exceeds an acceptable limit, using the determination parameter (RSRC).

With this configuration, the air-fuel ratio perturbation control is performed using the oscillation signal for oscillating the air-fuel ratio with the set frequency which is different from the 0.5th-order frequency, the intensity of the set frequency component contained in the output signal of the air-fuel ratio detecting means, is calculated during execution of the air-fuel ratio perturbation control, and the intensity of the 0.5th-order frequency component is calculated. The determination parameter applied to determining the imbalance degree of air-fuel ratios corresponding to the plurality of cylinders is calculated by multiplying the amplitude of the oscillation signal and the ratio of the 0.5th-order frequency component intensity to the set frequency component intensity, and the imbalance failure that the imbalance degree of the air-fuel ratios exceeds the acceptable limit, is determined using the determination parameter. By variably setting the amplitude of the oscillation signal, it is possible to reduce the range of the determination parameter values regardless of the imbalance degree of the air-fuel ratios. Further, by multiplying the amplitude of the oscillation signal and the ratio of the 0.5th-order frequency component intensity to the set frequency component intensity, the specific component, which is contained in the set frequency component intensity and depends on the amplitude of the oscillation signal, can be offset. Accordingly, the determination accuracy can be improved.

Preferably, the air-fuel ratio control system further includes predicted imbalance value calculating means for calculating a predicted imbalance value (RSRC, UADP) indicative of a predicted value of the imbalance degree. The amplitude setting means sets the amplitude (DAF) of the oscillation signal to a greater value as the predicted imbalance value (RSRC, UADP) increases.

With this configuration, the predicted imbalance value indicative of a predicted value of the imbalance degree is calculated, and the amplitude of the oscillation signal is set to a greater value as the predicted imbalance value increases. It is confirmed that such setting of the amplitude of the oscillation signal reduces the range of the calculated determination parameter values, to improve determination accuracy. Consequently, the imbalance failure determination can accurately be performed regardless of the imbalance degree.

DETAILED DESCRIPTION OF THE PREFERRED EMBODIMENTS

Preferred embodiments of the present invention will now be described with reference to the drawings.

First Embodiment

Figure 1:
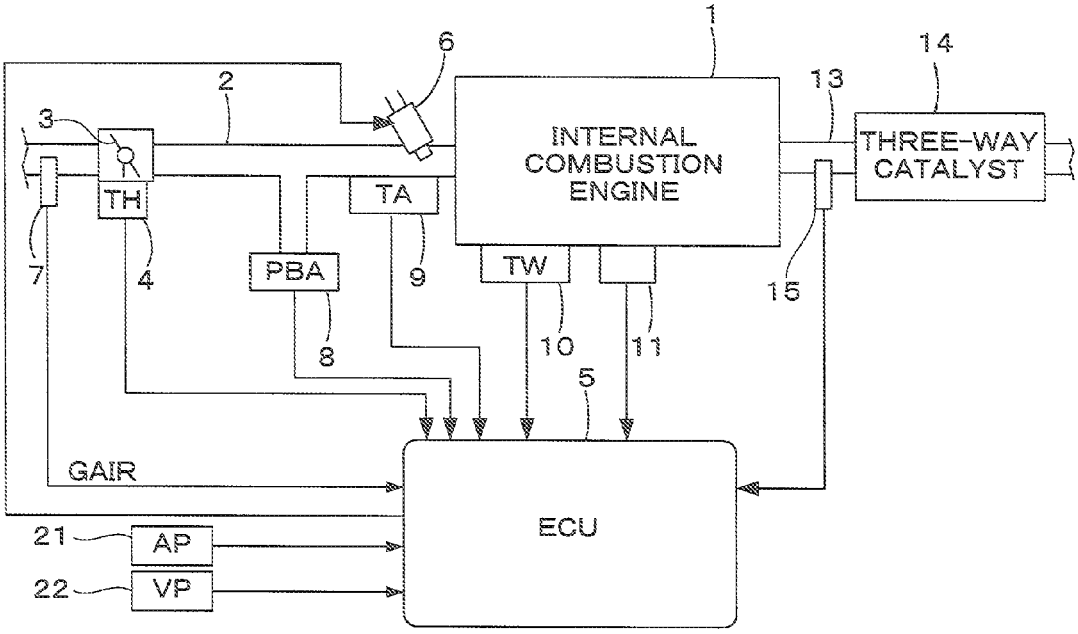
FIG. 1 shows a configuration of an internal combustion engine and an air-fuel ratio control system according to a first embodiment of the present invention.

FIG. 1 is a schematic diagram showing a general configuration of an internal combustion engine (hereinafter referred to as "engine") and an air-fuel ratio control system therefor, according to one embodiment of the present invention. The engine is, for example, a four-cylinder engine 1 having an intake pipe 2 provided with a throttle valve 3. A throttle valve opening sensor 4 for detecting a throttle valve opening TH is connected to the throttle valve 3, and the detection-signal is supplied to an electronic control unit 5 (hereinafter referred to as "ECU").

Fuel injection valves 6 are inserted into the intake pipe 2 at locations intermediate between the cylinder block of the engine 1 and the throttle valve 3 and slightly upstream of the respective intake valves (not shown). These fuel injection valves 6 are connected to a fuel pump (not shown) and electrically connected to the ECU 5. A valve opening period of each fuel injection valve 6 is controlled by a signal output from the ECU 5.

An intake air flow rate sensor 7 for detecting an intake air flow rate GAIR is disposed upstream of the throttle valve 3. Further, an intake pressure sensor 8 for detecting an intake pressure PBA and an intake air temperature sensor 9 for detecting an intake air temperature TA are disposed downstream of the throttle valve 3. An engine coolant temperature sensor 10 for detecting an engine coolant temperature TW is mounted on the body of the engine 1. The detection signals of these sensors are supplied to the ECU 5.

A crank angle position sensor 11 for detecting a rotation angle of a crankshaft (not shown) of the engine 1 is connected to the ECU 5, and a signal corresponding to a detected rotation angle of the crankshaft is supplied to the ECU 5. The crank angle position sensor 11 includes a cylinder discrimination sensor which outputs a pulse (hereinafter referred to as "CYL pulse") at a predetermined crank angle position for a specific cylinder of the engine 1. The crank angle position sensor 11 also includes a top dead center (TDC) sensor which outputs a TDC pulse at a crank angle position before a TDC of a predetermined crank angle starting at an intake stroke in each cylinder (i.e., at every 180-degree crank angle in the case of a four-cylinder engine) and a crank angle (CRK) sensor for generating one pulse (hereinafter referred to as "CRK pulse") with a CRK period (e.g., a period of 6 degrees, shorter than the period of generation of the TDC pulse). The CYL pulse, the TDC pulse and the CRK pulse are supplied to the ECU 5. The CYL, TDC and CRK pulses are used to control the various timings, such as a fuel injection timing and an ignition timing, and to detect an engine rotational speed NE.

The exhaust pipe 13 is provided with a three-way catalysts 14. The three-way catalyst 14 has oxygen storing capacity and stores oxygen contained in the exhaust gases in the exhaust lean condition where the air-fuel ratio of the air-fuel mixture supplied to the engine 1, is set to be lean with respect to the stoichiometric ratio, and the oxygen concentration in the exhaust gases is therefore relatively high. The three-way catalyst 14 oxidizes HC and CO contained in the exhaust gases with the stored oxygen in the exhaust rich condition where the air-fuel ratio of the air-fuel mixture supplied to the engine 1 is set to be rich with respect to the stoichiometric ratio, and the oxygen concentration in the exhaust gases is therefore low with a relatively large amount of HC and CO components.

A proportional type oxygen concentration sensor 15 (hereinafter referred to as "LAF sensor 15") is mounted on the upstream side of the three-way catalyst 14. The LAF sensor 15 outputs a detection signal substantially proportional to the oxygen concentration (air-fuel ratio) in the exhaust gases and supplies the detection signal to the ECU 5.

An accelerator sensor 21 and a vehicle speed sensor 22 are connected to the ECU 5. The accelerator sensor 21 detects an operation amount AP of the accelerator (not shown) of the vehicle driven by the engine 1 (hereinafter referred to as "the accelerator pedal operation amount AP"). The vehicle speed sensor 22 detects a running speed of the vehicle (vehicle speed) VP. The detection signals of the sensors 21 and 22 are supplied to the ECU 5. The throttle valve 3 is actuated by an actuator (not shown) to open and close, and the throttle valve opening TH is controlled by the ECU 5 according to the accelerator pedal operation amount AP.

It is to be noted that the engine 1 is provided with a well-known exhaust gas recirculation mechanism (not shown).

The ECU 5 includes an input circuit, a central processing unit (hereinafter referred to as "CPU"), a memory circuit, and an output circuit. The input circuit performs various functions, including shaping the waveforms of input signals from various sensors, correcting the voltage levels of the input signals to a predetermined level, and converting analog signal values into digital values. The memory circuit preliminarily stores various operating programs to be executed by the CPU and stores the results of computations, or the like, by the CPU. The output circuit supplies control signals to the fuel injection valves 6.

The CPU in the ECU 5 determines various engine operating conditions according to the detection signals of the various sensors described above and calculates a fuel injection period TOUT of each fuel injection valve 6 to be opened in synchronism with the TDC pulse for each cylinder, using the following equation (1) according to the above-determined engine operating conditions. The fuel injection period TOUT is also referred to as "fuel injection amount TOUT" since the fuel injection period TOUT is proportional to the injected fuel amount.

$$TOUT=TIM\times KCMD\times KAF\times KTOTAL \quad (1)$$

TIM is a basic fuel amount, specifically, a basic fuel injection period of each fuel injection valve 6, which is determined by retrieving a TIM table set according to the intake flow rate GAIR. The TIM table is set so that the air-fuel ratio of the air-fuel mixture burning in the engine 1 becomes substantially equal to the stoichiometric ratio.

KCMD is a target air-fuel ratio coefficient set according to the operating condition of the engine 1. The target air-fuel ratio coefficient KCMD is proportional to the reciprocal of the air-fuel ratio A/F, i.e., proportional to a fuel-air ratio F/A, and takes a value of "1.0" for the stoichiometric ratio. Accordingly, the target air-fuel ratio coefficient KCMD is hereinafter referred to as "target equivalent ratio". When performing the imbalance failure determination of the air-fuel ratio described below, the target equivalent ratio KCMD is set so as to change in the sinusoidal wave form as the time lapses within the range of (1.0±DAF).

KAF is an air-fuel ratio correction coefficient calculated using a PID (proportional, integral, and differential) control method or an adaptive control method with a self-tuning regulator so that a detected equivalent ratio KACT calculated from a detected value of the LAF sensor 15 coincides with the target equivalent ratio KCMD when an execution condition of the air-fuel ratio feedback control is satisfied.

KTOTAL is a product of other correction coefficients (a correction coefficient KTW according to the engine coolant temperature, a correction coefficient KTA according to the intake air temperature, and the like).

The CPU in the ECU 5 supplies a drive signal for opening each fuel injection valve 6 according to the fuel injection period TOUT obtained as described above through the output circuit to the fuel injection valve 6. Further, the CPU in the ECU 5 performs the imbalance failure determination of the air-fuel ratio as described below.

The method for determining the imbalance failure in this embodiment is an improvement of the method shown in JP-'754 described above. Specifically, the air-fuel ratio perturbation control in which the air-fuel ratio is oscillated with a frequency f1 is performed during engine operation, and the imbalance failure is determined using a ratio parameter RT which is obtained by dividing a 0.5th-order frequency component intensity MIMB by a f1-frequency component intensity MPf1, wherein both of the 0.5th-order frequency component and the f1-frequency component are contained in the output signal SLAF of the LAF sensor 15 during execution of the air-fuel ratio perturbation control. The 0.5th-order frequency component intensity MIMB is an intensity of the component corresponding to the 0.5th-order frequency f1 MB which is half of the engine rotational speed frequency fNE (=NE/60) corresponding to the engine rotational speed NE [rpm].

Figure 2:
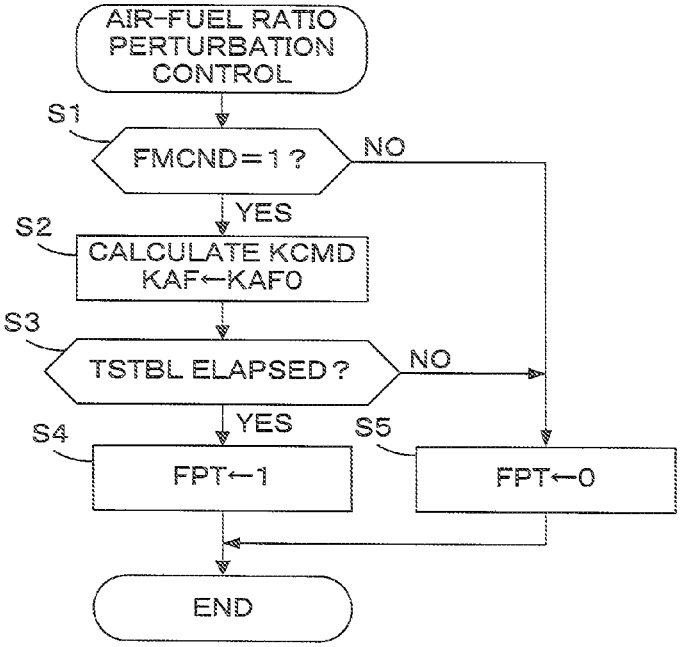
FIG. 2 is a flowchart of a process for performing the air-fuel ratio perturbation control.

FIG. 2 is a flowchart of the air-fuel ratio perturbation control process for the imbalance failure determination. This process is executed by the CPU in the ECU 5 at intervals of a predetermined crank angle CACAL (for example, 30 degrees).

In step S1, it is determined whether or not a determination execution condition flag FMCND is "1". The determination execution condition flag FMCND is set to "1" when all of the following conditions 1)-11) are fulfilled:

1) The engine rotational speed NE is within the range defined by a predetermined upper limit value and a predetermined lower limit value;

2) The intake pressure PBA is higher than a predetermined pressure (the exhaust gas flow rate required for the determination is secured);

3) The LAF sensor 15 is activated;

4) The air-fuel ratio feedback control according to the output of the LAF sensor 15 is being performed;

5) The engine coolant temperature TW is higher than a predetermined temperature;

6) The change amount DNE in the engine rotational speed NE per unit time period is less than a predetermined rotational speed change amount;

7) The change amount DPBAF in the intake pressure PBA per unit time period is less than a predetermined intake pressure change amount.

8) The acceleration increase in the fuel amount (which is performed at a rapid acceleration) is not performed;

9) The exhaust gas recirculation ratio is greater than a predetermined value;

10) The LAF sensor output is not in the state of being held at the upper limit value or the lower limit value; and 11) The response characteristic of the LAF sensor is normal (the deterioration failure in the response characteristic of the LAF sensor is not determined to have occurred).

If the answer to step S1 is negative (NO), an air-fuel ratio perturbation control flag FPT is set to "0" (step S5), and the process ends. If FMCND is equal to "1", the target equivalent ratio KCMD is calculated using the following equation (2), and the air-fuel ratio correction coefficient KAF is fixed to a predetermined value KAF0 (for example, "1.0"). Accordingly, the air-fuel ratio changes in the sinusoidal wave form. In the equation (2), Kf1 is an oscillation frequency coefficient which is set for example to "0.4", and "k" is a discrete time digitized with the execution period CACAL of this process. Further, DAF is an amplitude of the air-fuel ratio oscillation, which is set according to the predicted imbalance degree of the air-fuel ratios as described later.

$$KCMD=DAF\times\sin(Kf1\times CACAL\times k)+1 \quad (2)$$

In step S3, it is determined whether or not a predetermined stabilization time period TSTBL has elapsed from the time of starting the air-fuel ratio perturbation control. If the answer to step S3 is negative (NO), the process proceeds to step S5. If the answer to step S3 is affirmative (YES), an air-fuel ratio perturbation control flag FPT is set to "1".

Figure 3:
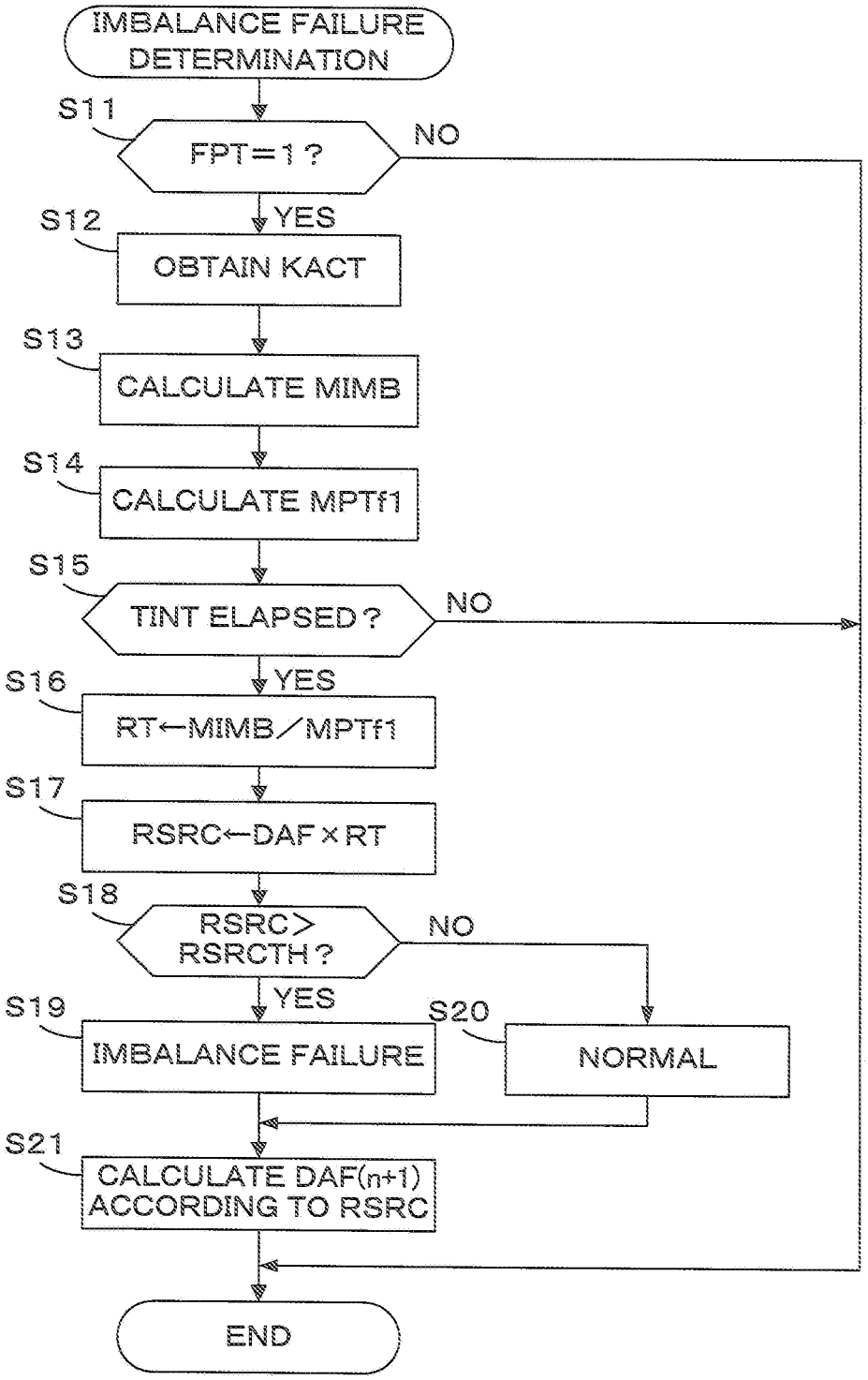
FIG. 3 is a flowchart of a process for determining the imbalance failure.

FIG. 3 is a flowchart of the imbalance failure determination process. This process is executed by the CPU in the ECU 5 at intervals of the predetermined crank angle CACAL similarly to the process of FIG. 2.

In step S11, it is determined whether or not the air-fuel ratio perturbation control flag FPT is "1". If the answer to step S11 is affirmative (YES), the detected equivalent ratio KACT is obtained, and the obtained value KACT is stored in the memory (step S12). The memory stores past values of the detected equivalent ratio KACT, wherein the number of the stored past values is set to a number required for calculating the 0.5th-order frequency component intensity MIMB and the f1-frequency component intensity MPTf1.

In step S13, the band-pass filtering is performed for extracting the 0.5th-order frequency component, and the 0.5th-order frequency component intensity MIMB is calculated by integrating the amplitude of the extracted signal. In step S14, the band-pass filtering is performed for extracting the f1-frequency component, and the f1-frequency component intensity MPTf1 is calculated by integrating the amplitude of the extracted signal.

In step S15, it is determined whether or not a predetermined integration time period TINT has elapsed from the time of starting calculation of the frequency component intensities. If the answer to step S15 is negative (NO), the process immediately ends. If the answer to step S15 is affirmative (YES), the ratio parameter RT is calculated by the following equation (3).

$$RT=MIMB/MPTf1 \quad (3)$$

In step S17, the ratio parameter RT and the perturbation control amplitude DAF are applied to the following equation (4), to calculate a determination parameter RSRC. The determination parameter RSRC is used in this embodiment also as a predicted imbalance value which is a predicted value of the imbalance degree.

$$RSRC=DAF\times RT \quad (4)$$

In step S18, it is determined whether or not the determination parameter RSRC is greater than a determination threshold value RSRCTH. If the answer to step S18 is affirmative (YES), the imbalance failure is determined to have occurred (step S19). On the other hand, if the answer to step S18 is negative (NO), the imbalance degree of the air-fuel ratio is determined to be in the allowable range (normal) (step S20).

Figure 4:
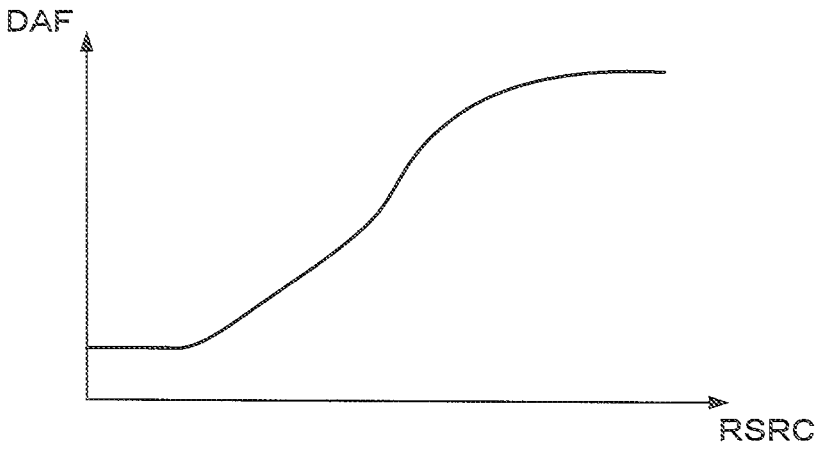
FIG. 4 shows a table referred to in the process of FIG. 3.

In step S21, a DAF table shown in FIG. 4 is retrieved according to the determination parameter RSRC to calculate the perturbation control amplitude DAF(n+1) applied to the next calculation of the equation (2). The DAF table is set so that the determination parameter RSRC increases as the perturbation control amplitude DAF increases. The initial value of the perturbation control amplitude DAF is set for example to a predetermined value corresponding to a low imbalance degree state, and the amplitude DAF(n+1) updated in step S21 is thereafter applied.

Figure 13A:
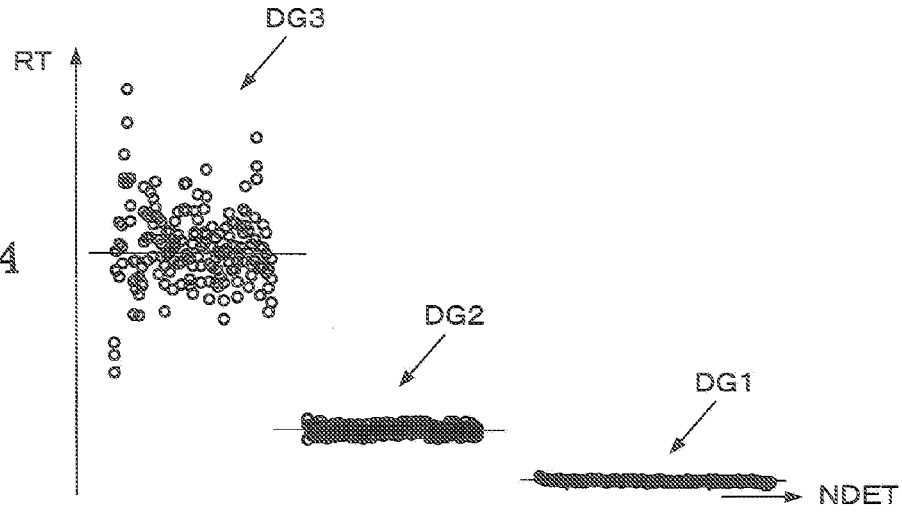
FIGS. 13A and 13B show graphs illustrating a problem of the prior art and an advantage obtained by the present invention.
Figure 13B:
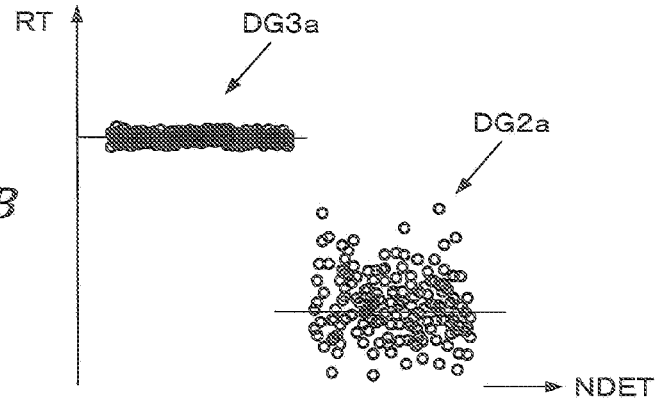

FIG. 13B shows distribution of values of the ratio parameter RT when setting the perturbation control amplitude DAF to a greater value than that of the example shown in FIG. 13A, corresponding to the high imbalance state. As apparent from FIG. 13B, the distribution width of the data group DG3*a* decreases compared with that of the data group DG3, whereas the distribution width of the data group DG2*a* increases compared with that of the data group DG2. Accordingly, by setting the perturbation control amplitude DAF according to the predicted imbalance degree, the calculation accuracy of the ratio parameter RT can be raised, thereby making it possible to accurately perform the imbalance failure determination regardless of the imbalance degree of the air-fuel ratios.

As described above, the air-fuel ratio perturbation control is performed using the oscillation signal for oscillating the air-fuel ratio with the frequency f1 which is different from the 0.5th-order frequency fIMB, the intensity MIMB of the 0.5th-order frequency component and the intensity MPTf1 of the f1-frequency component contained in the LAF sensor output signal SLAF are calculated during execution of the air-fuel ratio perturbation control. The determination parameter RSRC is calculated according to the 0.5th-order frequency component intensity MIMB and the f1-frequency component intensity MPTf1 and the imbalance failure is determined using the determination parameter RSRC. Further, the determination parameter RSRC is used as a predicted value of the imbalance degree of the air-fuel ratios, and the perturbation control amplitude DAF is set according to the determination parameter RSRC. Specifically, the perturbation control amplitude DAF is set so as to increase as the predicted imbalance degree increases. Accordingly, the air-fuel ratio perturbation control can be performed with the amplitude DAF suitable for the actual imbalance degree, which makes it possible to perform the determination with high accuracy regardless of the imbalance degree of the air-fuel ratios.

Further, the determination parameter RSRC is calculated by multiplying the perturbation control amplitude DAF and the ratio parameter RT, which offsets a specific component, which depends on the perturbation control amplitude DAF, contained in the f1-frequency component intensity MPTf1. Accordingly, the determination accuracy can be improved. In other words, setting the perturbation control amplitude DAF to a greater value according to the predicted imbalance degree does not make the determination parameter RSRC increase, which enables accurate determination of the actual imbalance degree.

Further in this embodiment, the determination parameter RSRC is used as the predicted imbalance value, which prevents the calculation process in the failure determination from becoming complicated.

In this embodiment, the LAF sensor 15 corresponds to the air-fuel ratio detecting means, the fuel injection valve 6 constitutes a part of the air-fuel ratio oscillating means, and the ECU 5 constitutes a part of the oscillation signal generating means, the air-fuel ratio oscillating means, the 0.5th-order frequency component intensity calculating means, the set frequency component intensity calculating means, the determination parameter calculating means, the imbalance failure determining means, the predicted imbalance value calculating means, and the amplitude setting means. Specifically, step S2 of FIG. 2 corresponds to the oscillation signal generating means, step S13 of FIG. 3 corresponds to the 0.5th-order frequency component intensity calculating means, step S14 corresponds to the set frequency component intensity calculating means, steps S16 and S17 correspond to the determination parameter calculating means, steps S18-S20 correspond to the imbalance failure determining means, step S17 corresponds to the predicted imbalance value calculating means, and step S21 corresponds to the amplitude setting means.

Modification 1

Figure 5:
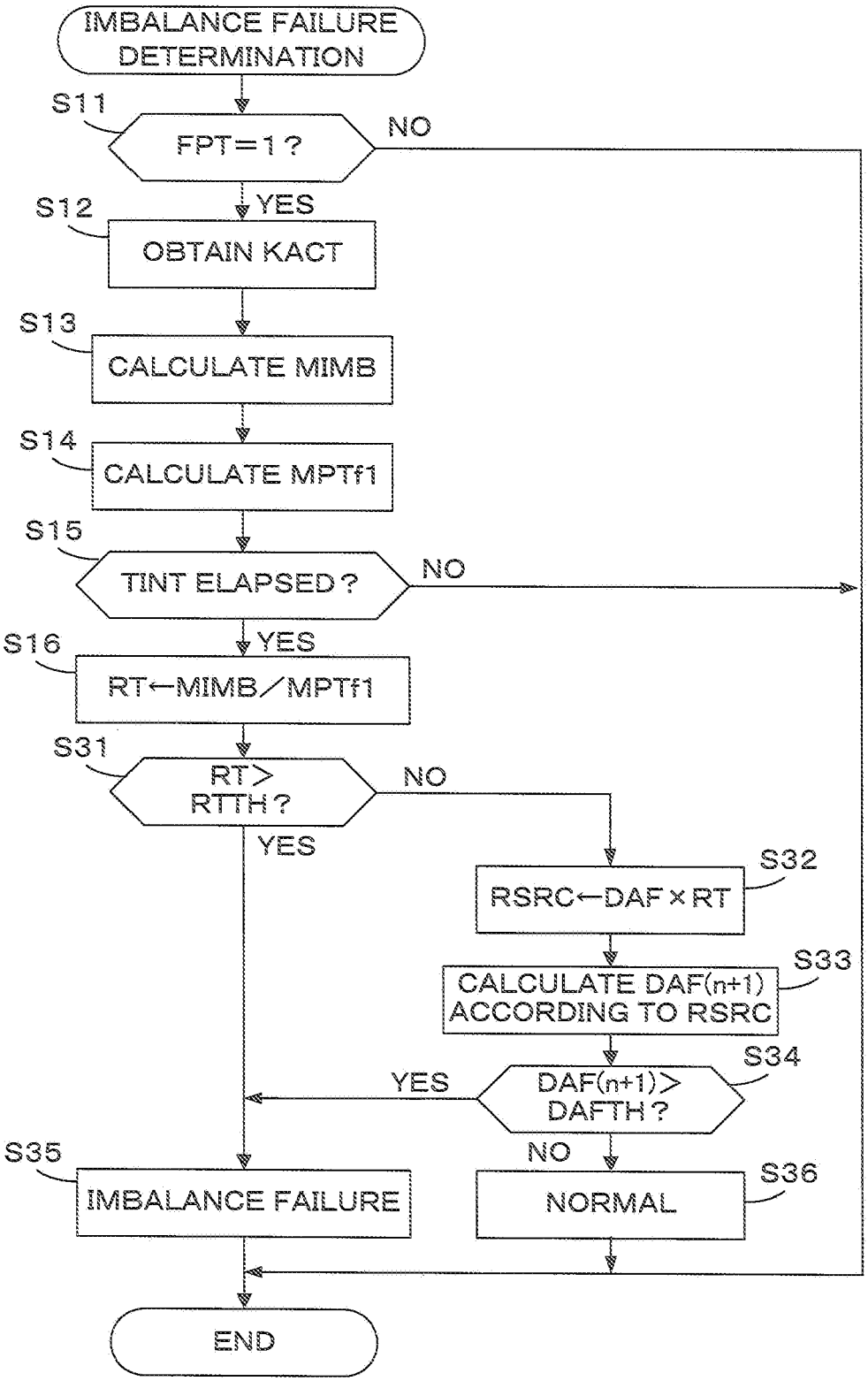
FIG. 5 is a flowchart of a modification of the process shown in FIG. 3.

The process of FIG. 3 may be modified as shown in FIG. 5. The process of FIG. 5 is obtained by deleting steps S17-S21 of FIG. 3 and adding steps S31-S36.

In step S31, it determined whether or not the ratio parameter RT is greater than a ratio threshold value RTTH. If the answer to step S31 is affirmative (YES), it is determined that the imbalance failure has occurred (step S35).

On the other hand, if the answer to step S31 is negative (NO), the predicted imbalance value (determination parameter) RSRC is calculated by the equation (5) (step S32). In step S33, the DAF table shown in FIG. 4 is retrieved according to the predicted imbalance value RSRC to calculate the next perturbation control amplitude DAF(n+1) (step S33). In step S34, it is determined whether or not the calculated perturbation control amplitude DAF(n+1) is greater than an amplitude threshold value DAFTH. If the answer to step S34 is affirmative (YES), it is determined that the imbalance failure has occurred. If the answer to step S34 is negative (NO), the imbalance degree of the air-fuel ratios is determined to be in the acceptable range (normal) (step S36).

In this modification, the ratio parameter RT is used as a main parameter for the determination like the prior art, wherein the ratio threshold value RTTH is set to a comparatively large value so as to prevent an erroneous failure determination when the imbalance degree is comparatively low. If the ratio parameter RT is equal to or less than the ratio threshold value RTTH, the next perturbation control amplitude DAF is calculated by the method similar to that in the above-described embodiment, and it is determined that the imbalance failure has occurred if the perturbation control amplitude DAF is greater than the amplitude threshold value DAFTH. Accordingly, determination accuracy can be made comparable to that in the above-described embodiment.

In this modification, step S16 of FIG. 5 corresponds to the determination parameter calculating means, step S32 corresponds to the predicted imbalance value calculating means, step S33 corresponds to the amplitude setting means, and steps S31 and S35 correspond to the imbalance failure determining means.

Modification 2

In the above-described embodiment, a present value of the perturbation control amplitude DAF and the ratio parameter RT are applied to the equation (4) to calculate the determination parameter RSRC, and the next perturbation control amplitude DAF(n+1) is calculated using the determination parameter RSRC as the predicted imbalance value. Alternatively, the next perturbation control amplitude DAF(n+1) may be previously calculated according to the present value of the perturbation control amplitude DAF and the ratio parameter RT, and the calculated values of the next perturbation control amplitude DAF(n+1) may be stored in the memory as a DAF map. In this case, the next perturbation control amplitude DAF(n+1) is calculated by retrieving the DAF map according to the present value of the perturbation control amplitude DAF and the ratio parameter RT.

Second Embodiment

Figure 6:
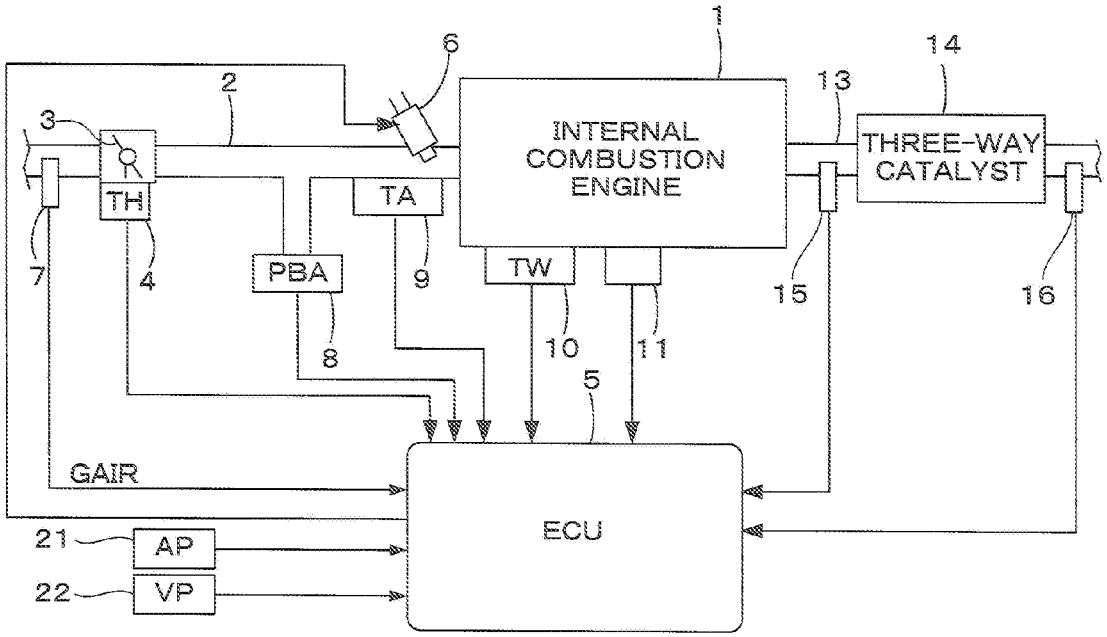
FIG. 6 shows a configuration of an internal combustion engine and an air-fuel ratio control system according to a second embodiment of the present invention.

FIG. 6 shows a configuration of an internal combustion engine and an air-fuel ratio control system according to the second embodiment of the present invention. The air-fuel ratio control system shown in FIG. 6 is obtained by adding a binary type oxygen concentration sensor (hereinafter referred to as "O2 sensor") 16 disposed downstream of the three-way catalyst 14 in the system of FIG. 1. The detection signal of the O2 sensor 16 is supplied to the ECU 5. This embodiment is the same as the first embodiment except for the points described below.

The O2 sensor 16 has a characteristic such that the sensor output VO2 rapidly changes when the air-fuel ratio AF is in the vicinity of the stoichiometric ratio AFST. Specifically, the O2 sensor output VO2 is high if the air-fuel ratio AF is richer than the stoichiometric ratio AFST, whereas VO2 is low if the air-fuel ratio AF is leaner than the stoichiometric ratio AFST.

In this embodiment, the LAF feedback control is performed to calculate the air-fuel ratio correction coefficient KAF so that the detected equivalent ratio KACT coincides with the target equivalent ratio KCMD, while the O2 feedback control is performed to set the target equivalent ratio KCMD so that the O2 sensor output VO2 coincides with target value VO2TRGT. This air-fuel ratio control method is the same as the air-fuel ratio control method for performing the two feedback controls in parallel, which is already well known (for example, shown in Japanese Patent Laid-open Publication No. 2011-241349, etc.). The O2 feedback control is performed using the sliding mode control. An outline of the O2 feedback control is described below with reference to FIG. 7.

Figure 7:
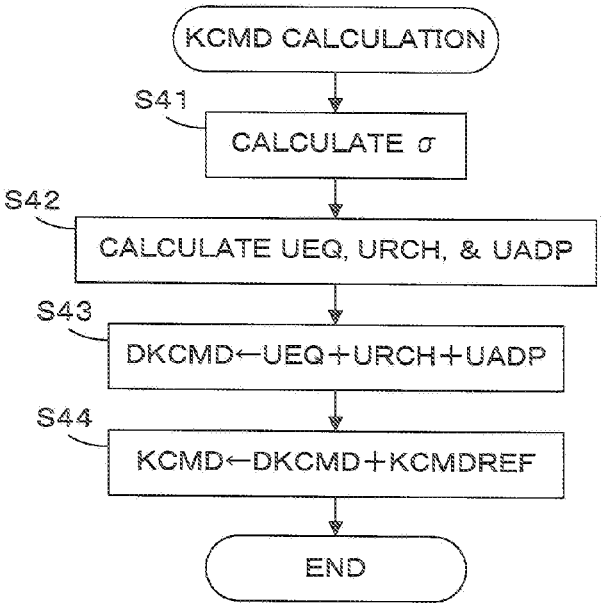
FIG. 7 is a flowchart of a process for calculating a target equivalent ratio (KCMD) in the normal air-fuel ratio control.

In step S41 of FIG. 7, the O2 sensor output VO2 and the target value VO2TRGT are applied to the following equation (11) to calculate a control deviation DVO2, and the control deviation DVO2 is applied to the following equation (12) to calculate a switching function value σ. In the equations (11) and (12), "i" is a discrete time digitized with the execution period (calculation period of KCMD) of the process of FIG. 7. "VPOLE" in the equation (12) is a response characteristic specifying parameter which determines the reducing characteristic of the control deviation DVO2, which is set to a value greater than "−1" and less than "0".

$$DVO2(i)=VO2(i)-VO2TRGT(i) \tag{11}$$

$$\sigma(i)=DVO2(i)+VPOLE\times DVO2(i-1) \tag{12}$$

In step S42, the equivalent control input UEQ, the reaching law control input URCH, and the adaptive law control input UADP in the sliding mode control are calculated by the following equations (13)-(15) using the switching function value σ. A1, A2, B, and C in these equations are control coefficients calculated using the model parameters of the controlled object model and the response characteristic specifying parameter VPOLE. "d" in the equation (13) is a discrete dead time period and "DT" in the equation (15) is the calculation period of KCMD.

$$UEQ=A1\times DVO2(i+d)+A2\times DVO2(i+d-1) \tag{13}$$

$$URCH=B\times\sigma(i) \tag{14}$$

$$UADP=C\times\Sigma(\sigma(i)\times DT) \tag{15}$$

In step S43, the equivalent control input UEQ, the reaching law control input URCH, and the adaptative law control input UADP are applied to the following equation (16) to calculate an equivalent ratio deviation amount DKCMD.

$$DKCMD=UEQ+URCH+UADP \tag{16}$$

In step S44, the equivalent ratio deviation amount DKCMD is applied to the following equation (17) to calculate the target equivalent ratio KCMD. In the equation (17), KCMDREF is a learning value which takes a value in the vicinity of "1.0".

$$KCMD=DKCMD+KCMDREF \quad (17)$$

The adaptive law control input UADP calculated by the equation (15) corresponds to the integration term in the PID control (proportional, integral, and differential control), and is proportional to an integrated value of the switching function value σ which takes a value according to the control deviation DVO2.

Figure 8:
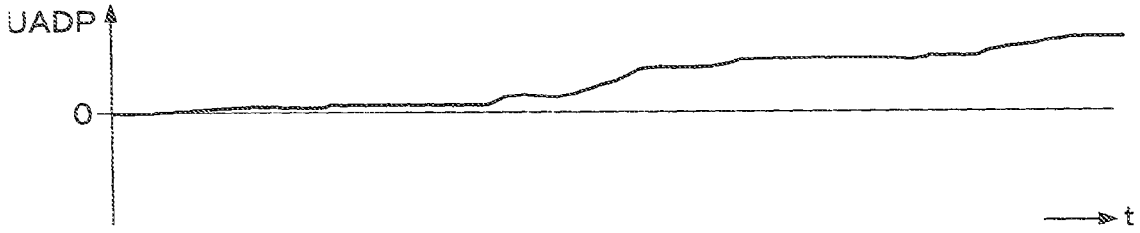
FIG. 8 is a time chart showing changes in the adaptive control input (UADP) calculated in the process of FIG. 7.

It is confirmed that the adaptive law control input UADP increases as the time lapses as shown in FIG. 8 if the imbalance degree of air-fuel ratios becomes larger. This is due to the fact that the detected equivalent ratio KACT, which is calculated according to the LAF sensor output VLAF, takes a value indicative of an air-fuel ratio richer than the actual average air-fuel ratio when the imbalance of air-fuel ratios has occurred.

Figure 9:
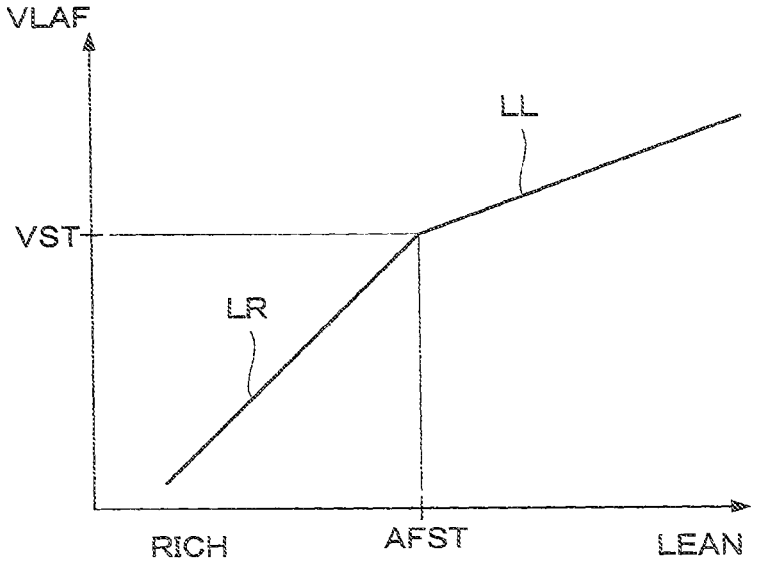
FIG. 9 shows a detection characteristic of a proportional-type oxygen concentration sensor.

FIG. 9 shows a relationship between the LAF sensor output VLAF and the air-fuel ratio AF. The inclination of the straight line LR corresponding to the air-fuel ratio richer than the stoichiometric ratio AFST differs from that of the straight line LL corresponding to the air-fuel ratio leaner than the stoichiometric ratio AFST, i.e., the inclination of the line LR is greater than that of the line LL. Since the LAF sensor 15 has the characteristic shown in FIG. 9, the LAF sensor output VLAF takes a value indicative of an air-fuel ratio richer than the actual average air-fuel ratio when the imbalance of air-fuel ratios has occurred.

Accordingly, the O2 sensor output VO2 steadily takes a value lower than the target value VO2TRGT (deviates to a leaner value), and the adaptive control input UADP is modified to eliminate this steady state error. As a result, the adaptive control input UADP increases as the time lapses as shown in FIG. 8, and the value of the adaptive law control input UADP at the time of reaching the steady state increases as the imbalance degree increases. In this embodiment, since the control deviation DVO2 is calculated by the equation (11), the switching function value σ decreases in the negative direction (the absolute value of σ increases) as the imbalance degree increases, and hence the integral term (Σ(σ(i)×DT) of the equation (15) decreases in the negative direction. Consequently, the adaptive control input UADP increases since the control coefficient C of the equation (15) is set to a negative value. As a result, the target equivalence ratio KCMD increases to eliminate the steady state error of the O2 sensor output VO2.

In this embodiment, the adaptive law control input UADP is therefore used as the predicted imbalance value, and the perturbation control amplitude DAF is set according to the adaptive law control input UADP.

Figure 10:
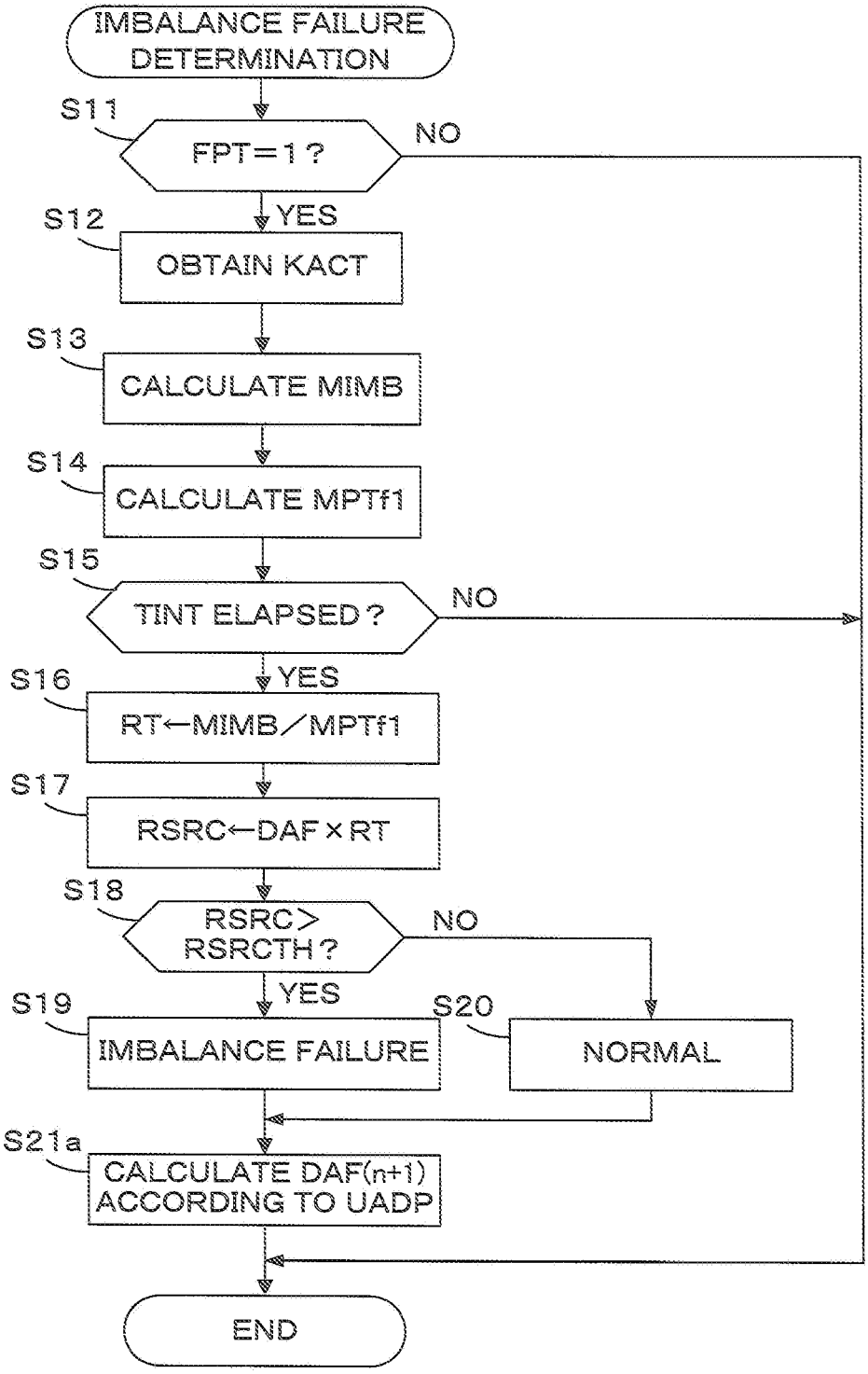
FIG. 10 is a flowchart of a process for determining the imbalance failure (second embodiment)
Figure 11:
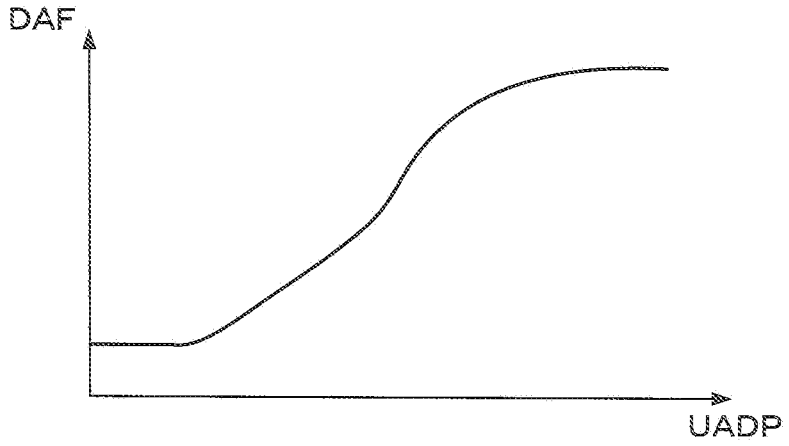
FIG. 11 shows a table referred to in the process of FIG. 10.

FIG. 10 is a flowchart of the imbalance failure determination process in this embodiment. This process is obtained by replacing step S21 of FIG. 2 with step S21*a*. In step S21*a*, a DAF table shown in FIG. 11 is retrieved according to the adaptive law control input UADP to calculate the perturbation control amplitude DAF.

When performing the air-fuel ratio perturbation control, the target equivalent ratio KCMD is calculated by the above-described equation (2).

According to this embodiment, the target equivalence ratio KCMD is set using the adaptive law control input UADP corresponding to the integral term of the switching function value σ depending on the control deviation, so that the O2 sensor output VO2 coincides with the target-value VO2TRGT. Further, the air-fuel ratio correction coefficient KAF is calculated so that the detected equivalent ratio KACT coincides with the target equivalent ratio KCMD, and the adaptive law control input UADP is used as the predicted imbalance value.

It is confirmed that the adaptive law control input UADP increases as the imbalance degree of air-fuel ratios becomes larger. Accordingly, the adaptive law control input UADP can be used as the predicted imbalance value. The predicted imbalance value (adaptive law control input UADP) is calculated by a method different from the calculation method of the determination parameter RSRC, which makes it possible to appropriately set the oscillation signal amplitude DAF to suppress deterioration of the determination accuracy, even when errors in the determination parameter RSRC temporarily increase due to disturbance, an exchange in the relevant parts, or the like.

In this embodiment, the LAF sensor 15 corresponds to the upstream air-fuel ratio detecting means, the O2 sensor 16 corresponds to the downstream air-fuel ratio detecting means, the process of FIG. 7 corresponds to the first feedback control means, the process for calculating the air-fuel ratio correction coefficient KAF so that the detected equivalent ratio KACT coincides with the target equivalent ratio KCMD, corresponds to the second feedback control means, step S42 of FIG. 8 corresponds to the predicted imbalance value calculating means, and step S21*a* of FIG. 10 corresponds to the amplitude setting means.

Modification 1

Figure 12:
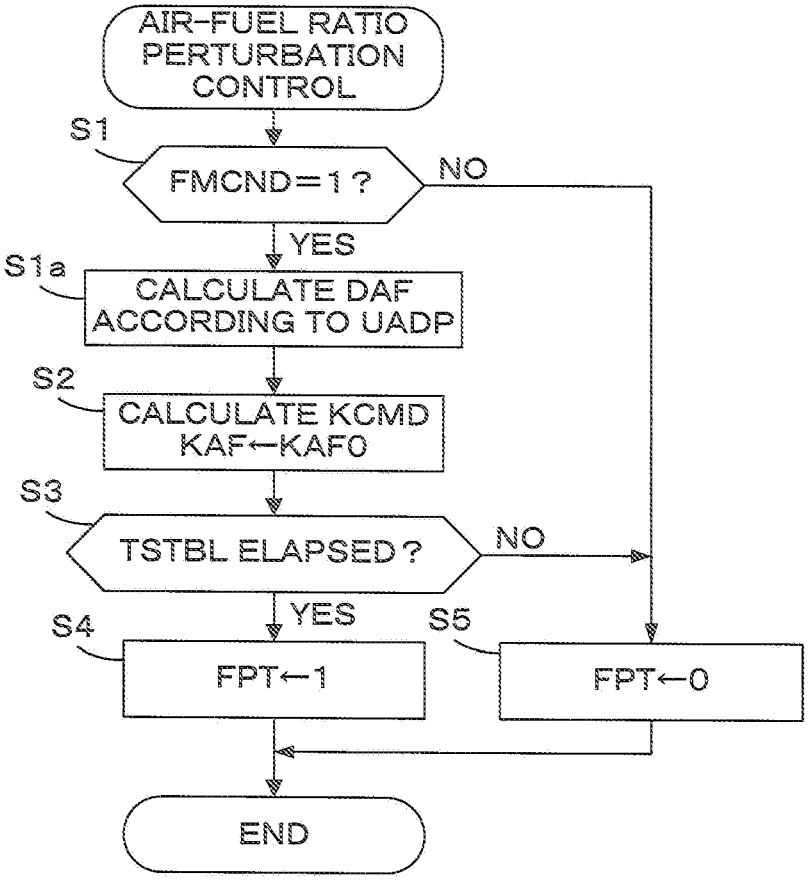
FIG. 12 is a flowchart of a modification of the process shown in FIG. 2.

In this embodiment, the air-fuel ratio perturbation control may be performed by the process shown in FIG. 12 instead of the process of FIG. 2. The process of FIG. 12 is obtained by adding step S1*a* to the process of FIG. 2.

In step S1*a*, the DAF table of FIG. 11 is retrieved according to the adaptive law control input UADP to calculate the amplitude DAF. The process thereafter proceeds to step S2.

The adaptive law control input UADP is calculated during the normal control in which the imbalance failure determination is not performed. Accordingly, by calculating the amplitude DAF according to the adaptive law control input UADP when the execution condition of the imbalance failure determination is satisfied, and performing the air-fuel ratio perturbation control using the calculated amplitude DAF, the air-fuel ratio perturbation control can be performed more appropriately.

In this modification, step S1*a* of FIG. 12 corresponds to the amplitude setting means.

Modification 2

The process similar to the modification 1 of the first embodiment may be used also in this embodiment.

Modification 3

In the above-described embodiment, the target equivalent ratio KCMD is calculated with the sliding mode control in the KCMD calculation process of FIG. 7. Alternatively, the target equivalent ratio KCMD may be calculated with the PID (proportional, integral, and differential) control. In this case, the integral term IDVO2 proportional to the integrated value of the control deviation DVO2 can be used as the predicted imbalance value. The integral term IDVO2 increases as the imbalance degree increases, since the control gain multiplied to the integrated value of the control deviation DVO2 is set to a negative value.

Further, in stead of using the adaptive law control input UADP or the integral term IDVO2 as the predicted imbalance value, a parameter IMBP obtained by multiplying the adaptive law control input UADP or the integral term IDVO2 with a predetermined value KC may be used as the predicted imbalance value, wherein the predetermined value KC is set so that the obtained parameter IMBP appropriately indicates the imbalance degree.

The present invention is not limited to the embodiments described above, and various modifications may be made. In the above-described embodiments, the first frequency f1 of the air-fuel ratio perturbation control is set to a value obtained by multiplying the engine rotational speed frequency fNE and a constant value, i.e., the first frequency f1 is set to the frequency synchronized with the engine rotation. Alternatively, the first frequency f1 may be set to a fixed frequency, e.g., about 4 [Hz]. In this case, the allowable range of the engine rotational speed NE included in the execution condition of the failure determination is preferably limited to a comparatively narrow range.

Further, the calculation process of frequency component intensities may be performed at optimum intervals, independently from the failure determination process. In this case, the frequency component intensity calculation is not performed in the failure determination process, and the failure determination is performed by reading the frequency component intensities (the 0.5-order frequency component intensity MIMB, the first frequency component intensity MPTf1) which are calculated in the frequency component intensity calculation process executed in parallel. Alternatively, the LAF sensor output signal SLAF may be sampled at the optimum intervals during a predetermined sampling period from the time the air-fuel perturbation control has become stabilized, and the sampled data may be stored in the memory. After the predetermined sampling period, the frequency component intensities may be calculated by a batch process of the sampled data. In such case, the FFT (Fast Fourier Transformation) can be used for the batch process.

Further, in the above-described embodiments, the calculation of the 0.5th-order frequency component intensity MIMB is performed during execution of the air-fuel perturbation control. Alternatively, the calculation may be performed when the air-fuel perturbation control is not performed. In this case, it is preferable that the engine operating region where the air-fuel perturbation control is performed to calculate the f1-frequency component intensity MPTf1 may be limited to a comparatively narrow engine operating region and the calculation of the 0.5th-order frequency component intensity MIMB may be performed in the limited engine operating region.

Further, the present invention can also be applied to an air-fuel ratio control system for a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An air-fuel ratio control system for an internal combustion engine having a plurality of cylinders, comprising:

air-fuel ratio detecting means for detecting an air-fuel ratio in an exhaust passage of said engine;

oscillation signal generating means for generating an oscillation signal to oscillate the air-fuel ratio with a set frequency which is different from a 0.5th-order frequency which is half of the frequency corresponding to a rotational speed of said engine;

air-fuel ratio oscillating means for oscillating the air-fuel ratio according to the oscillation signal;

0.5th-order frequency component intensity calculating means for calculating an intensity of the 0.5th-order frequency component contained in an output signal of said air-fuel ratio detecting means;

set frequency component intensity calculating means for calculating an intensity of the set frequency component contained in the output signal of said air-fuel ratio detecting means during operation of said air-fuel ratio oscillating means;

determination parameter calculating means for calculating a determination parameter applied to determining an imbalance degree of air-fuel ratios corresponding to the plurality of cylinders according to the 0.5th-order frequency component intensity and the set frequency component intensity;

imbalance failure determining means for determining an imbalance failure that the imbalance degree of the air-fuel ratios exceeds an acceptable limit, using the determination parameter;

predicted imbalance value calculating means for calculating a predicted imbalance value indicative of a predicted value of the imbalance degree; and amplitude setting means for setting an amplitude of the oscillation signal according to the predicted imbalance value.

2. The air-fuel control system according to claim 1, wherein said amplitude setting means sets the amplitude of the oscillation signal to a greater value as the predicted imbalance value increases.

3. The air-fuel control system according to claim 1, wherein said determination parameter calculating means calculates the determination parameter by multiplying the amplitude of the oscillation signal and a ratio of the 0.5th-order frequency component intensity to the set frequency component intensity.

4. The air-fuel control system according to claim 2, wherein said determination parameter calculating means calculates the determination parameter by multiplying the amplitude of the oscillation signal and a ratio of the 0.5th-order frequency component intensity to the set frequency component intensity.

5. The air-fuel control system according to claim 1, wherein said predicted imbalance value calculating means calculates the predicted imbalance value so that the predicted imbalance value increases as a modified amplitude increases, the modified amplitude being obtained by multiplying the amplitude of the oscillation signal and a ratio of the 0.5th-order frequency component intensity to the set frequency component intensity.

6. The air-fuel control system according to claim 2, wherein said predicted imbalance value calculating means calculates the predicted imbalance value so that the predicted imbalance value increases as a modified amplitude increases, the modified amplitude being obtained by multiplying the amplitude of the oscillation signal and a ratio of the 0.5th-order frequency component intensity to the set frequency component intensity.

7. The air-fuel control system according to claim 3, wherein said predicted imbalance value calculating means calculates the predicted imbalance value so that the predicted imbalance value increases as a modified amplitude increases, the modified amplitude being obtained by multiplying the amplitude of the oscillation signal and a ratio of the 0.5th-order frequency component intensity to the set frequency component intensity.

8. The air-fuel control system according to claim 4, wherein said predicted imbalance value calculating means calculates the predicted imbalance value so that the predicted imbalance value increases as a modified amplitude increases, the modified amplitude being obtained by multiplying the amplitude of the oscillation signal and a ratio of the 0.5th-order frequency component intensity to the set frequency component intensity.

9. The air-fuel control system according to claim 1, wherein said exhaust passage is provided with an exhaust gas purifying catalyst, said air-fuel ratio detecting means is upstream air-fuel ratio detecting means disposed upstream of said exhaust gas purifying catalyst, and downstream air-fuel ratio detecting means is disposed downstream of said exhaust gas purifying catalyst, wherein said air-fuel control system further includes:

first feedback control means for setting a target air-fuel ratio using an integral control term of a parameter indicative of a control deviation so that a detected value of said downstream air-fuel ratio detecting means coincides with a downstream target value; and second feedback control means for controlling the air-fuel ratio of an air-fuel mixture burning in said engine so that the air-fuel ratio detected by said upstream air-fuel ratio detecting means coincides with the target air-fuel ratio, wherein said predicted imbalance value calculating means calculates the predicted imbalance value so that the predicted imbalance value increases as the integral control term increases.

10. The air-fuel control system according to claim 2, wherein said exhaust passage is provided with an exhaust gas purifying catalyst, said air-fuel ratio detecting means is upstream air-fuel ratio detecting means disposed upstream of said exhaust gas purifying catalyst, and downstream air-fuel ratio detecting means is disposed downstream of said exhaust gas purifying catalyst, wherein said air-fuel control system further includes:

first feedback control means for setting a target air-fuel ratio using an integral control term of a parameter indicative of a control deviation so that a detected value of said downstream air-fuel ratio detecting means coincides with a downstream target value; and second feedback control means for controlling the air-fuel ratio of an air-fuel mixture burning in said engine so that the air-fuel ratio detected by said upstream air-fuel ratio detecting means coincides with the target air-fuel ratio, wherein said predicted imbalance value calculating means calculates the predicted imbalance value so that the predicted imbalance value increases as the integral control term increases.

11. The air-fuel control system according to claim 3, wherein said exhaust passage is provided with an exhaust gas purifying catalyst, said air-fuel ratio detecting means is upstream air-fuel ratio detecting means disposed upstream of said exhaust gas purifying catalyst, and downstream air-fuel ratio detecting means is disposed downstream of said exhaust gas purifying catalyst, wherein said air-fuel control system further includes:

first feedback control means for setting a target air-fuel ratio using an integral control term of a parameter indicative of a control deviation so that a detected value of said downstream air-fuel ratio detecting means coincides with a downstream target value; and second feedback control means for controlling the air-fuel ratio of an air-fuel mixture burning in said engine so that the air-fuel ratio detected by said upstream air-fuel ratio detecting means coincides with the target air-fuel ratio, wherein said predicted imbalance value calculating means calculates the predicted imbalance value so that the predicted imbalance value increases as the integral control term increases.

12. The air-fuel control system according to claim 4, wherein said exhaust passage is provided with an exhaust gas purifying catalyst, said air-fuel ratio detecting means is upstream air-fuel ratio detecting means disposed upstream of said exhaust gas purifying catalyst, and downstream air-fuel ratio detecting means is disposed downstream of said exhaust gas purifying catalyst, wherein said air-fuel control system further includes:

first feedback control means for setting a target air-fuel ratio using an integral control term of a parameter indicative of a control deviation so that a detected value of said downstream air-fuel ratio detecting means coincides with a downstream target value; and second feedback control means for controlling the air-fuel ratio of an air-fuel mixture burning in said engine so that the air-fuel ratio detected by said upstream air-fuel ratio detecting means coincides with the target air-fuel ratio, wherein said predicted imbalance value calculating means calculates the predicted imbalance value so that the predicted imbalance value increases as the integral control term increases.

13. An air-fuel ratio control system for an internal combustion engine having a plurality of cylinders, comprising:

air-fuel ratio detecting means for detecting an air-fuel ratio in an exhaust passage of said engine;

oscillation signal generating means for generating an oscillation signal to oscillate the air-fuel ratio with a set frequency which is different from a 0.5th-order frequency which is half of the frequency corresponding to a rotational speed of said engine;

amplitude setting means for variably setting an amplitude of the oscillation signal;

air-fuel ratio oscillating means for oscillating the air-fuel ratio according to the oscillation signal;

0.5th-order frequency component intensity calculating means for calculating an intensity of the 0.5th-order frequency component contained in an output signal of said air-fuel ratio detecting means;

set frequency component intensity calculating means for calculating an intensity of the set frequency component contained in the output signal of said air-fuel ratio detecting means during operation of said air-fuel ratio oscillating means;

determination parameter calculating means for calculating a determination parameter applied to determining an imbalance degree of air-fuel ratios corresponding to the plurality of cylinders by multiplying the amplitude of the oscillation signal and a ratio of the 0.5th-order frequency component intensity to the set frequency component intensity; and imbalance failure determining means for determining an imbalance failure that the imbalance degree of the air-fuel ratios exceeds an acceptable limit, using the determination parameter.

14. The air-fuel control system according to claim 13, further comprising predicted imbalance value calculating means for calculating a predicted imbalance value indicative of a predicted value of the imbalance degree, wherein said amplitude setting means sets the amplitude of the oscillation signal to a greater value as the predicted imbalance value increases.

15. The air-fuel control system according to claim 13, wherein said predicted imbalance value calculating means calculates the predicted imbalance value so that the predicted imbalance value increases as a modified amplitude increases, the modified amplitude being obtained by multiplying the amplitude of the oscillation signal and the ratio of the 0.5th-order frequency component intensity to the set frequency component intensity.

16. The air-fuel control system according to claim 14, wherein said predicted imbalance value calculating means calculates the predicted imbalance value so that the predicted imbalance value increases as a modified amplitude increases, the modified amplitude being obtained by multiplying the amplitude of the oscillation signal and the ratio of the 0.5th-order frequency component intensity to the set frequency component intensity.

17. The air-fuel control system according to claim 13, wherein said exhaust passage is provided with an exhaust gas purifying catalyst, said air-fuel ratio detecting means is upstream air-fuel ratio detecting means disposed upstream of said exhaust gas purifying catalyst, and downstream air-fuel ratio detecting means is disposed downstream of said exhaust gas purifying catalyst, wherein said air-fuel control system further includes:

first feedback control means for setting a target air-fuel ratio using an integral control term of a parameter indicative of a control deviation so that a detected value of said downstream air-fuel ratio detecting means coincides with a downstream target value; and second feedback control means for controlling the air-fuel ratio of an air-fuel mixture burning in said engine so that the air-fuel ratio detected by said upstream air-fuel ratio detecting means coincides with the target air-fuel ratio, wherein said predicted imbalance value calculating means calculates the predicted imbalance value so that the predicted imbalance value increases as the integral control term increases.

18. The air-fuel control system according to claim 14, wherein said exhaust passage is provided with an exhaust gas purifying catalyst, said air-fuel ratio detecting means is upstream air-fuel ratio detecting means disposed upstream of said exhaust gas purifying catalyst, and downstream air-fuel ratio detecting means is disposed downstream of said exhaust gas purifying catalyst, wherein said air-fuel control system further includes:

first feedback control means for setting a target air-fuel ratio using an integral control term of a parameter indicative of a control deviation so that a detected value of said downstream air-fuel ratio detecting means coincides with a downstream target value; and second feedback control means for controlling the air-fuel ratio of an air-fuel mixture burning in said engine so that the air-fuel ratio detected by said upstream air-fuel ratio detecting means coincides with the target air-fuel ratio, wherein said predicted imbalance value calculating means calculates the predicted imbalance value so that the predicted imbalance value increases as the integral control term increases.

* * * * *